US008091859B2

(12) United States Patent
Kienzler et al.

(10) Patent No.: US 8,091,859 B2
(45) Date of Patent: Jan. 10, 2012

(54) VALVE FOR CONTROLLING FLUIDS

(75) Inventors: Dieter Kienzler, Leonberg (DE); Dietmar Schmieder, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 1334 days.

(21) Appl. No.: 10/556,289

(22) PCT Filed: Mar. 19, 2004

(86) PCT No.: PCT/DE2004/000568

§ 371 (c)(1),
(2), (4) Date: Nov. 9, 2005

(87) PCT Pub. No.: WO2004/104404

PCT Pub. Date: Dec. 2, 2004

(65) Prior Publication Data

US 2006/0278837 A1 Dec. 14, 2006

(30) Foreign Application Priority Data

May 20, 2003 (DE) ..... 103 22 673

(51) Int. Cl.
*F02M 51/06* (2006.01)

(52) U.S. Cl. ..... 251/86; 251/129.06

(58) Field of Classification Search ..... 251/129.06, 251/129.01, 86, 84; 123/446

See application file for complete search history.

(56) References Cited

U.S. PATENT DOCUMENTS

| | | | | |
|---|---|---|---|---|
| 5,094,430 | A * | 3/1992 | Shirai et al. | 251/129.06 |
| 5,810,255 | A * | 9/1998 | Itoh et al. | 251/129.06 |
| 6,119,952 | A * | 9/2000 | Kappel et al. | 239/88 |
| 6,142,443 | A * | 11/2000 | Potschin et al. | 251/129.06 |
| 6,354,271 | B1 * | 3/2002 | Satapathy | 123/446 |
| 6,363,913 | B1 * | 4/2002 | Milam et al. | 123/446 |
| 6,394,070 | B1 * | 5/2002 | Angelino | 123/446 |
| 6,499,467 | B1 * | 12/2002 | Morris et al. | 123/446 |
| 6,499,471 | B2 * | 12/2002 | Shen et al. | 123/498 |
| 6,520,423 | B1 | 2/2003 | Ricci-Ottati et al. | |
| 6,568,602 | B1 * | 5/2003 | Bram et al. | 251/129.06 |
| 6,575,138 | B2 * | 6/2003 | Welch et al. | 123/467 |
| 6,676,030 | B2 * | 1/2004 | Lorraine et al. | 251/129.06 |
| 6,749,129 | B2 * | 6/2004 | Hefler et al. | 239/88 |

FOREIGN PATENT DOCUMENTS

DE 101 40 529 A1 3/2003

OTHER PUBLICATIONS

English Translation of Kienzler et al. DE 10140529 A1 reference for BPAI.*

* cited by examiner

*Primary Examiner* — John Bastianelli
(74) *Attorney, Agent, or Firm* — Ronald E. Greigg

(57) ABSTRACT

A valve for controlling fluids having a piezoelectric actuator unit which has an actuator base and an actuator head that acts on a coupling module which is connected to a valve closing member that cooperates with a valve seat; the actuator base is braced via a spherical face on a conical seat of a valve housing and has an O-ring seal on its circumference. The spherical face of the actuator base is located on the side of the O-ring seal facing away from the actuator head.

3 Claims, 2 Drawing Sheets

VALVE FOR CONTROLLING FLUIDS

CROSS-REFERENCE TO RELATED APPLICATIONS

This application is a 35 USC 371 application of PCT/DE 2004/000568 filed on Mar. 19, 2004.

BACKGROUND OF THE INVENTION

1. Field of the Invention

The invention is directed to an improved valve for controlling fluids, and more particularly to such a valve which may be used in a fuel injection system.

2. Description of the Prior Art

One valve known from German Patent Disclosure DE 101 40 529 A1 can be used for instance in a fuel injection valve, in particular in a common rail injector of a diesel internal combustion engine of a motor vehicle.

The valve known from DE 101 40 529 A1 includes a piezoelectric actuator unit, which has an actuator base and an actuator head. The actuator base is braced, via a rounded, annular edge, on a conical seat that is embodied on a valve housing. The actuator head acts on a coupling module, which includes a so-called adjusting piston which is connected to the actuator head and is operatively connected to a so-called actuating piston via a hydraulic coupler. The actuating piston acts on a valve closing member, which cooperates with a valve seat and by means of which a stream of fluid can be controlled.

Because the actuator base is supported on the spherical face of the valve housing via the rounded edge, tolerance-dictated skewed positions and assembly-dictated shifting of the actuator head can be compensated for. For sealing purposes, an O-ring is supported in an annular groove in the region of the actuator base. As viewed from the direction of the actuator head, the O-ring is located behind the rounded edge.

The structural group formed of the piezoelectric actuator unit and the coupling module forms a valve control unit of the fuel injection valve and serves to control a nozzle needle, which is located in an injector module of the fuel injection valve and cooperates with injection openings that lead to a combustion chamber of the engine.

In the installation of the known valve, the actuator base is prestressed by a spring sleeve, which surrounds the coupling module, with a force of approximately 700 N. Upon compensation for a tolerance-dictated skewed position and assembly-dictated shifting of the actuator head, a frictional moment occurs in the region of the rounded edge, which acts as a ball bearing. This frictional moment generates bending stresses, which can lead to damage, in the piezoelectric actuator unit.

To avoid leaks in the region of the O-ring seal, the regions of the actuator base that define the annular groove for the O-ring are located in the valve housing with a slight lateral play. The slight play disadvantageously means that the possible rotation of the actuator base is very slight, and as a result it may not be possible to compensate adequately for the incident tolerance-dictated rotations and assembly-dictated shifting of the actuator head.

Moreover, there is the problem in the known valve that the O-ring must be stretched greatly to be installed in the annular groove; on the one hand, this means increased effort in installation and on the other it can lead to increased rotation of the O-ring, and this rotation can disadvantageously cause leaks.

SUMMARY AND ADVANTAGES OF THE INVENTION

The valve for controlling fluids of the invention in which valve the spherical face of the actuator base is located behind the O-ring seal as viewed from the direction of the actuator head, has the advantage that compared to the known valve described above, by suitably locating the spherical face in the region of the ball bearing or the rounded edge, a smaller friction radius can be achieved, which causes less moment of resistance in the bearing region. In the event of tolerance-caused rotation and assembly-dictated shifting of the actuator head, this means a lesser bending moment that is exerted on the piezoelectric actuator unit. The friction radius and the incident bending stresses in the piezoelectric actuator unit can be reduced by up to 50%, compared to the known valve.

The valve for controlling fluids of the invention in particular forms a valve control unit of a fuel injection valve, in particular a common rail injector of an internal combustion engine of a motor vehicle.

In a preferred embodiment of the valve of the invention, the O-ring seal is slipped onto a region of the actuator base of reduced diameter. The O-ring seal, which preferably has an inside diameter that is slightly smaller than the diameter of the region of the actuator base having the reduced diameter, can thus be installed simply and securely, since the risk of rotation of the O-ring during assembly, which can disadvantageously cause leaks, is reduced.

BRIEF DESCRIPTION OF THE DRAWINGS

One exemplary embodiment of the valve of the invention is described more fully herein below, in conjunction with the drawings, in which.

DESCRIPTION OF THE PREFERRED EMBODIMENT

Figure 1:
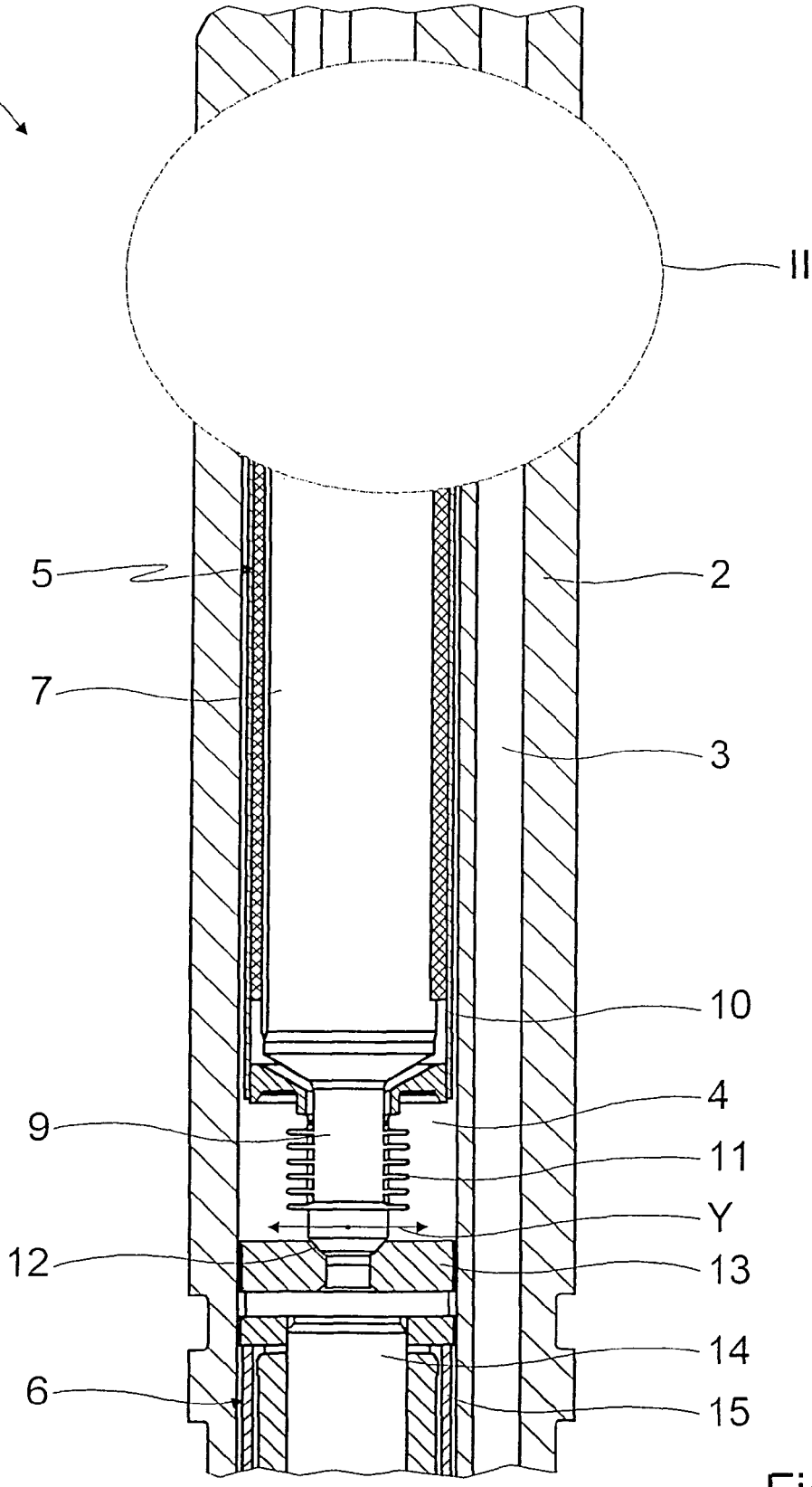
FIG. 1 shows a longitudinal section through a valve of the invention, in a fragmentary view.
Figure 2:
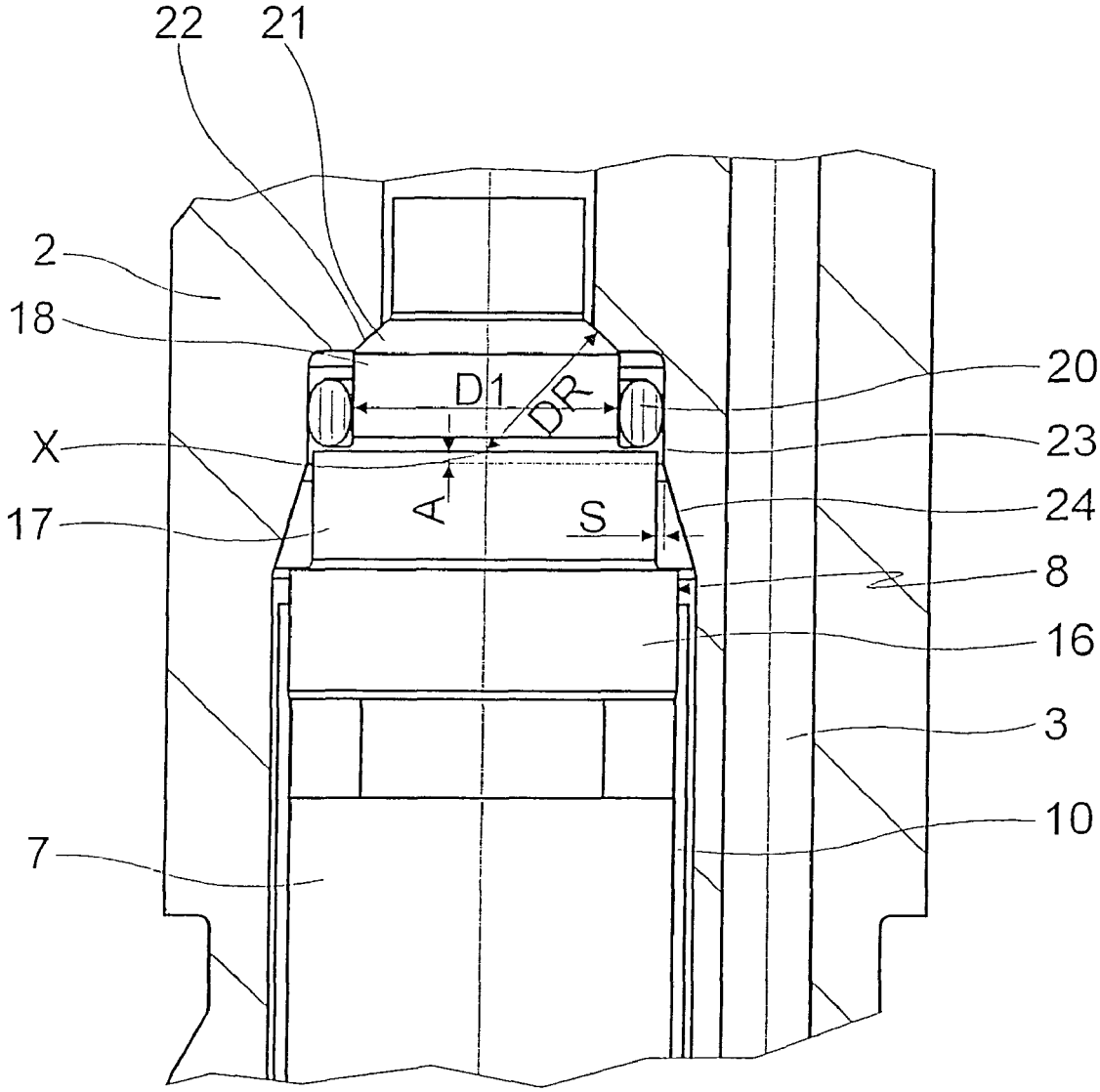
FIG. 2 shows an enlarged view of the region II outlined in dashed lines in FIG. 1.

In FIGS. 1 and 2, a valve control unit 1 is shown of a fuel injection valve which serves as a common rail injector for injecting preferably diesel fuel into a combustion chamber of a diesel internal combustion engine, not shown further here, of a motor vehicle.

The fuel injection valve includes, besides the valve control unit 1, a nozzle module, not further shown, in which an axially displaceable nozzle needle is located that is operatively connected to so-called injection openings that lead to the combustion chamber of the engine. The valve control unit 1 serves to actuate the nozzle needle.

The valve control unit 1 includes a valve housing 2, in which an axially oriented fuel supply conduit 3, which leads to the nozzle module, is embodied along with a receiving chamber 4 for a piezoelectric actuator unit 5 and a hydraulic coupling module 6.

The piezoelectric actuator module 5 includes a piezoelectric actuator 7, which is located between an actuator base 8 and an actuator head 9. To protect against fuel, the piezoelectric actuator unit 5 is encapsulated, specifically by means of both a tubular sleeve 10, solidly joined to the actuator base 8, and a bellows diaphragm 11 which surrounds the actuator head 9 and is joined to the sleeve 10 and is designed to receive an axial bearing of the piezoelectric actuator 7.

The actuator head 9, which serves to transmit the change in length of the piezoelectric actuator 7 to the coupling module 6, engages a disk 13, which is provided with a corresponding recess 12 and is solidly joined to an adjusting piston 14 of the coupling module 6, which piston is in turn coupled, via a hydraulic coupler, not shown, embodied as a hydraulic chamber, to an actuating piston, also not shown. The actuating piston is connected in turn to a valve closing member, which cooperates with a valve seat and upon whose actuation a change in pressure takes place in a valve control chamber of the nozzle module, as a result of which the nozzle needle experiences an axial displacement, so that the injection openings are opened and closed.

The coupling module 6 further includes a spring sleeve 15, by means of which prestressing of the piezoelectric actuator module 5 takes place at a force of approximately 700 N.

The actuator base 8, which is shown in further detail in FIG. 2, is embodied in graduated form and includes a first region 16, directly adjoining the piezoelectric actuator 7, whose diameter is approximately equivalent to that of the piezoelectric actuator 7 and which changes over into a second region 17 of medium diameter, which is in turn adjoined by a third region 18 of reduced diameter. An O-ring seal 20 is pressed or slipped onto the region of reduced diameter and rests on the wall of the valve housing 2. The third region 18 of reduced diameter of the actuator base 8 has a diameter D1 which is somewhat greater than the inside diameter of the O-ring 20, so that the latter is seated securely on the third region 18 of reduced diameter of the actuator base 8.

The third region 18 of reduced diameter of the actuator base 8 is adjoined, in the direction facing away from the piezoelectric actuator 7, by a curved face or spherical face 21, embodied as a ball bearing, which is braced on a conical seat 22 that is embodied on the valve housing 2. The spherical face 21 is defined by a radius DR, known as a friction radius, and tilting of the actuator base 8 about a pivot point X can occur.

Between the second region 17 of medium diameter of the actuator base 8 and the wall of the valve housing 2, a gap S is embodied, which can be selected to be large enough that any tolerance-dictated rotation and/or assembly-dictated shifting of the actuator head 9 in the radial direction that may occur, events that are represented in FIG. 1 as examples by a double arrow marked Y, can be compensated for. This effect is also contributed to by a small spacing A, which is embodied between the pivot point X and the transition between a cylindrical region 23 of reduced diameter of the receiving chamber 4 and a conical region 24 of the receiving chamber 4.

The foregoing relates to preferred exemplary embodiments in the invention, it being understood that other variants and embodiments thereof are possible within the spirit and scope of the invention, the latter being defined by the appended claims.

The invention claimed is:

1. For use in a valve for controlling fluids, a piezoelectric actuator unit which has an actuator base and an actuator head that acts on a coupling module, wherein the actuator base includes a spherical face which is braced against a conical seat of a valve housing and which actuator base has an O-ring seal on its circumference, wherein the spherical face of the actuator base is located on the side of the O-ring seal facing away from the actuator head.

2. The valve as recited in claim 1, further comprising a region of reduced diameter of the actuator base, and wherein the O-ring seal is slipped onto the region of reduced diameter.

3. The valve as recited in claim 2, wherein the O-ring seal has an inside diameter which is slightly smaller than the diameter of the region of reduced diameter of the actuator base.

* * * * *